United States Patent [19]

Thompson

[11] 3,939,861

[45] Feb. 24, 1976

[54] FIRE HYDRANT

[76] Inventor: William J. Thompson, 8133 Ridge Ave., Philadelphia, Pa. 19128

[22] Filed: July 19, 1974

[21] Appl. No.: 490,212

[52] U.S. Cl. ..... 137/299; 251/149.4; 251/149.6; 285/38; 285/388

[51] Int. Cl.[2] ..... E03B 9/04; F16L 37/28

[58] Field of Search ..... 137/272, 294–300, 137/317, 320, 322, 798, 614.19; 251/145, 149.1, 149.4, 149.5, 149.6, 149.7, 153; 285/38, 387, 388

[56] References Cited

UNITED STATES PATENTS

| | | | |
|---|---|---|---|
| 401,263 | 4/1889 | Fruen | 251/149.7 X |
| 516,323 | 3/1894 | Wolters | 251/149.5 X |
| 1,020,917 | 3/1912 | Linscott et al. | 137/296 |
| 1,802,497 | 4/1931 | Bozowich | 251/149.6 |
| 2,083,319 | 6/1937 | Daviet | 137/299 |
| 2,480,174 | 8/1949 | Yost | 285/387 X |

*Primary Examiner*—Martin P. Schwadron
*Assistant Examiner*—Richard Gerard
*Attorney, Agent, or Firm*—Smith, Harding, Earley & Follmer

[57] ABSTRACT

A fire hydrant designed to prevent the unauthorized use of an outlet nozzle which is located on the above ground barrel portion of the stand pipe. The hydrant includes a valve means located within the barrel portion and provided with a valve member which is biased to a closed position extending across the upstream end of the outlet nozzle. A valve actuator is provided to be threaded onto the outlet nozzle for moving the valve member away from the closed position to an open position permitting the flow of water through the outlet nozzle.

7 Claims, 8 Drawing Figures

FIRE HYDRANT

BACKGROUND OF THE INVENTION

This invention relates to fire hydrants and more particularly to a fire hydrant construction provided with means for preventing the unauthorized use of the fire hydrant.

The fire hydrants in use today comprise a stand pipe which extends upwardly from an elbow which is connected to the main water supply pipe line. A control valve is located at the juncture between the bottom of the stand pipe and the elbow for controlling the flow of water to the fire hydrant. At its upper end, the stand pipe is provided with an above ground portion or barrel which includes at least one steamer nozzle or outlet nozzle extending laterally therefrom. The control valve operating rod also extends upwardly from the control valve through the barrel portion to the top thereof whereat it is accessible to authorized personnel for opening the control valve when desired, such as in the case of a fire when a fire hose is connected to the fire hydrant.

Unfortunately, the fire hydrant is completely unprotected and may be operated at will by unauthorized persons. The resultant water loss, and drop in water pressure, is a matter of major concern to many cities.

Unauthorized persons are able to open the fire hydrant by gaining access to an operating nut at the upper end of the operating rod and opening the control valve.

The prior art attempts to prevent the unauthorized operation of fire hydrants have generally been directed to preventing access to the operating mechanism at the upper end of the barrel. However, this has not proved to be satisfactory and the problem in most cities is still a very serious one and has not been solved.

Another problem encountered in many cities is the abuse of the fire hydrant by using it as a depository. Presently, many water departments are having difficulty with people throwing cans and bottles and other debris down the fire hydrant. The articles are thrown into the fire hydrant by way of the steamer nozzle which can be opened by removing a cover. This is a serious problem with the fire department personnel because they are unaware of the article in a fire hydrant which may make it unusable during a fire. Sometimes the article causes damage to the fire hose and also blocks the proper flow of water.

SUMMARY OF THE INVENTION

This invention relates to a fire hydrant construction which prevents the unauthorized use and abuse of fire hydrants.

Briefly stated, the invention comprises the provision of a valve means which is located within the barrel portion of the stand pipe for blocking the flow of water through the steamer nozzle. The valve means includes a valve member movable between a closed position in which the valve member extends across the upstream end of the outlet nozzle to thereby block the flow of water from the interior of the barrel into the outlet nozzle and at the same time prevent the insertion of articles into the barrel through the outlet nozzle. The valve member is movable to an open position spaced from the upstream end of the outlet nozzle to permit the flow of water from the interior of the barrel into the outlet nozzle when it is desired to use the fire hydrant. The valve means includes a spring means for biasing the valve member towards the closed position. A valve actuator means is provided for moving the valve member from the closed position to the open position against the bias of the spring means. To this end there is provided a collar means which is adapted to be mounted on the fire hydrant in a position surrounding the outlet nozzle. The collar means carries a valve actuating member which is arranged to move into the outlet nozzle to contact the valve member to move it from closed position to open position as the collar is mounted on the fire hydrant.

The above-described novel construction prevents the unauthorized use of the fire hydrant by maintaining the steamer or outlet nozzle closed at all times except when authorized personnel wish to use the fire hydrant. The valve means is located entirely within the barrel of the fire hydrant so that it cannot be easily removed by unauthorized personnel. Moreover, the construction is such as to provide a minimum of resistance to flow when in the open position.

The invention possesses other advantages and features which, together with the foregoing, will be pointed specifically hereinafter. It is to be understood that the invention is not to be limited to the scope of the specific forms herein shown and described and that various embodiments thereof may be employed within the scope of the claims set forth hereinafter.

DETAILED DESCRIPTION OF THE PREFERRED EMBODIMENTS

Figure 1:
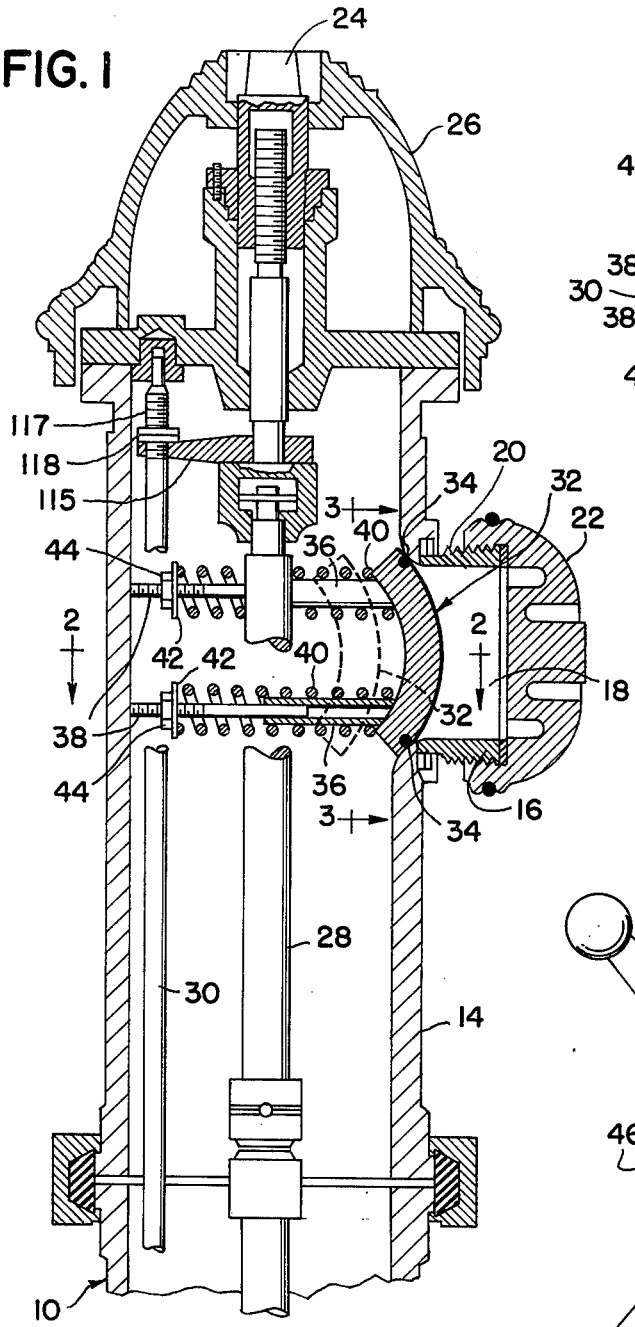
FIG. 1 is an elevational view, partly in section, of a fire hydrant in accordance with the invention.

Referring to FIG. 1, the fire hydrant in accordance with the invention comprises the usual stand pipe 10 which is connected at its bottom end to a conventional elbow casting located under ground and connected to the main water supply pipe as is conventional in the art. Above ground, the hydrant comprises a barrel portion 14, which has a laterally extending steamer or outlet nozzle 16 mounted thereon and having a circular opening 18. The nozzle 16 is provided with external threads 20 which are engageable with a cap 22 for closing the nozzle 16 when the fire hydrant is not in use.

As is conventional, the fire hydrant is operated from the top by means of a top operating nut 24 which is angular and projects above a hood 26 threadedly mounted on the upper end of the barrel 14. The operating nut 24 is connected through conventional operating mechanism to an extension stem 28 connected to a conventional plug valve at the lower end of the stand pipe 10 for controlling flow from the elbow casting into the lower end of the stand pipe 10. There is also provided a drip rod 30 which extends from the upper end of the barrel 14 downwardly to control a drip port, which construction is conventional in the art.

In accordance with the invention, means are provided for preventing the unauthorized operation of the fire hydrant to supply water from the steamer nozzle 16 and to prevent the insertion of articles into the barrel 14 through the nozzle 16. To this end, there is provided a disk-like valve member 32 which is located within the barrel 14 and is arranged to cooperate with the valve seat provided by the side opening 18 in the barrel 14. The valve member 32 is arranged to be positioned to block flow from the interior of the barrel 14 outwardly through the nozzle 16. This position is shown in solid lines in FIG. 1, the valve member 32 being arranged to block the upstream end of the nozzle 16 to thereby block flow therethrough. An O-ring seal 34 is mounted on the valve member 32 to cooperate with the valve seat provided by opening 18.

Means are provided for guiding the valve member 32 for movement from the closed position shown in solid lines in FIG. 1 to an open position shown in dashed lines in FIG. 1. To this end, the valve member is provided with four tubular sleeves 36 which project inwardly therefrom in a transverse direction across the barrel 14. The sleeves 36 slidably receive four transversely extending guide pins 38 which are mounted on and project inwardly from the opposite portion of the barrel 14 to extend into an associated sleeve 36 for guiding the movement thereof.

Spring means are provided for biasing the valve member 32 toward its closed position, comprising a compression spring 40 mounted on each cooperating pin 38 and sleeve 36 as is shown in the drawings. Each spring 40 extends between the valve member 32 and a washer 42 positioned on an associated pin 38. A nut 44 is threadedly mounted on each pin 38 and is axially adjustable thereon to adjust the position of the associated washer 42 to thereby vary the amount of compression of an associated spring 40. The springs 40 are adjusted to a compressed condition so as to maintain a considerable force biasing the valve member 32 toward the closed position. Moreover, this force is adjustable by the axial adjustment of the nuts 44 so as to achieve the desired conditions of operation.

Figure 4:
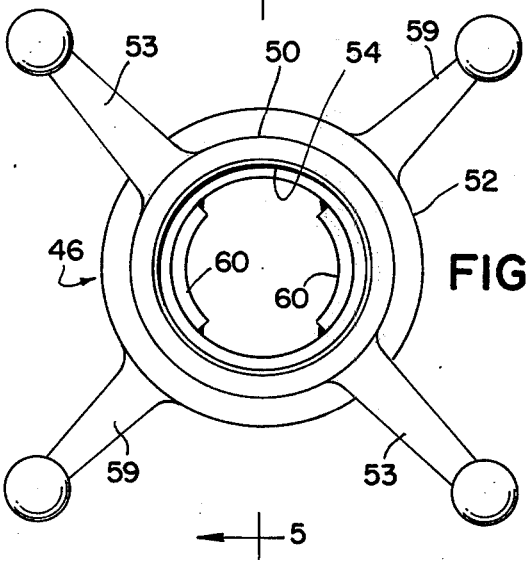
FIG. 4 is an end view of a valve actuator for use with the fire hydrant of the invention.
Figure 5:
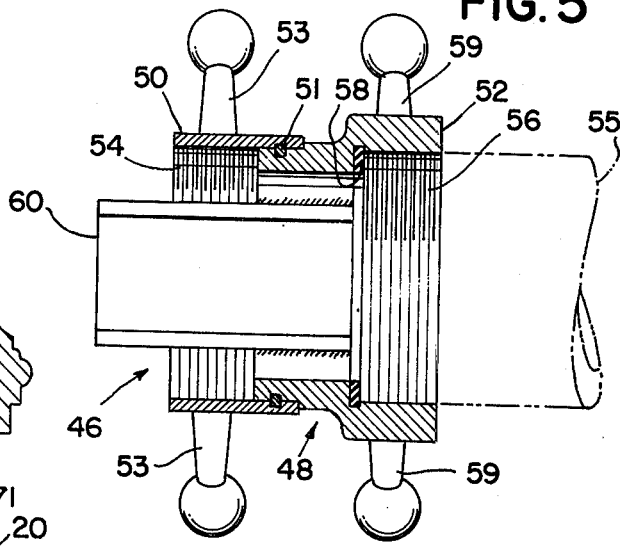
FIG. 5 is a sectional view of the valve actuator shown in FIG. 4 taken on line 5—5 of FIG. 4 and in larger scale for illustrative purposes.

Means are provided for moving the valve member 32 from the closed position to the open position to permit the authorized operation of the fire hydrant. Such means comprises a valve actuator 46 which is shown in FIGS. 4 and 5 and comprises a collar means 48 which can be threaded onto threads 20 of the nozzle 16. The collar means 48 is shown as a hose connection and is provided with a valve actuating member which moves into the outlet nozzle 16 to contact the valve member 32 to move it from closed to open position as the collar means 48 is threaded onto the outlet nozzle 16. The collar means 48 comprises a pair of cooperable collars 50 and 52, with collar 50 being mounted on the end of the collar 52 by means of a snap ring 51 which permits free relative rotatable movement between the collars 50 and 52. Collar 50 is internally threaded at 54 which threads are cooperable with the threaded portion 20 of the nozzle 16. Collar 50 is also provided with a pair of handles 53 for use in turning the collar. Collar 52 is a typical collar for connection to a fire hose 55 and is provided with internal threads 56 for connection to the fire hose 55. Collar 52 is also provided with a suitable washer 58 and operating handles 59.

The valve actuating means comprises a pair of arcuate members 60 which are secured to the internal wall of the collar 52 as by welding. The arcuate members 60 extend from the collar 52 beyond the end of the collar 50 as is shown in FIG. 5 for contacting the valve member 32 to open the valve as the collar means 48 is being screwed onto the fire hydrant threads 20 of nozzle 16.

It will be apparent that the fire hydrant in accordance with the invention prevents its unauthorized use. If an unauthorized person desired to operate the fire hydrant and was able to open the main control valve by operating the nut 24 or the stem 28, water passing up through the stand pipe 10 and into the barrel 14 could not flow out of the nozzle 16 because of the blocking action of the valve member 32. The unauthorized person could not open this valve member 32 since it is extremely difficult to gain access thereto through the top of the hydrant because of the obstruction provided by the top cover 26 and all the operating mechanism for the main control valve. To open the valve member 32 by way of the outlet nozzle 16 is also extremely difficult and would require a specially constructed opening device which would not be available to unauthorized persons.

Since the valve means for closing the outlet nozzle is located completely within the barrel 14, it cannot be removed without considerable time and effort. To remove this mechanism it is necessary to take the hydrant almost completely apart by taking off the top cap, the top plate, all the seals and gaskets that are associated therewith, and much of the mechanism used to operate the stem 28 and the rod 30.

The valve means also serves to prevent the insertion of articles into the barrel 14 through the outlet nozzle 16 since it blocks access to the interior thereof. Accordingly, the fire hydrant is constructed to prevent its use as a depository by unauthorized persons and thus prevents possible damage to the fire hydrant and the fire hose that is used therewith.

When it is desired to operate the fire hydrant for delivering water to a fire hose or the like, the cap 22 is removed and a hose connection comprising the valve actuator 46 as shown in FIGS. 4 and 5 is connected to the nozzle 16. This is achieved by threadedly engaging the collar 50 with the external threads 20 of the nozzle 16. As the collar 50 is threaded onto the nozzle 16 the pusher bars 60 move the valve member 32 away from the upstream end of the nozzle 16 to the dashed line position shown in FIG. 1. The upstream end of the nozzle 16 is now open to permit the flow of water upwardly through the stand pipe 10 and the barrel 14 through the opening 18 and through the nozzle 16 to the hose 55 for the use by the firemen or other authorized personnel.

Figure 6:
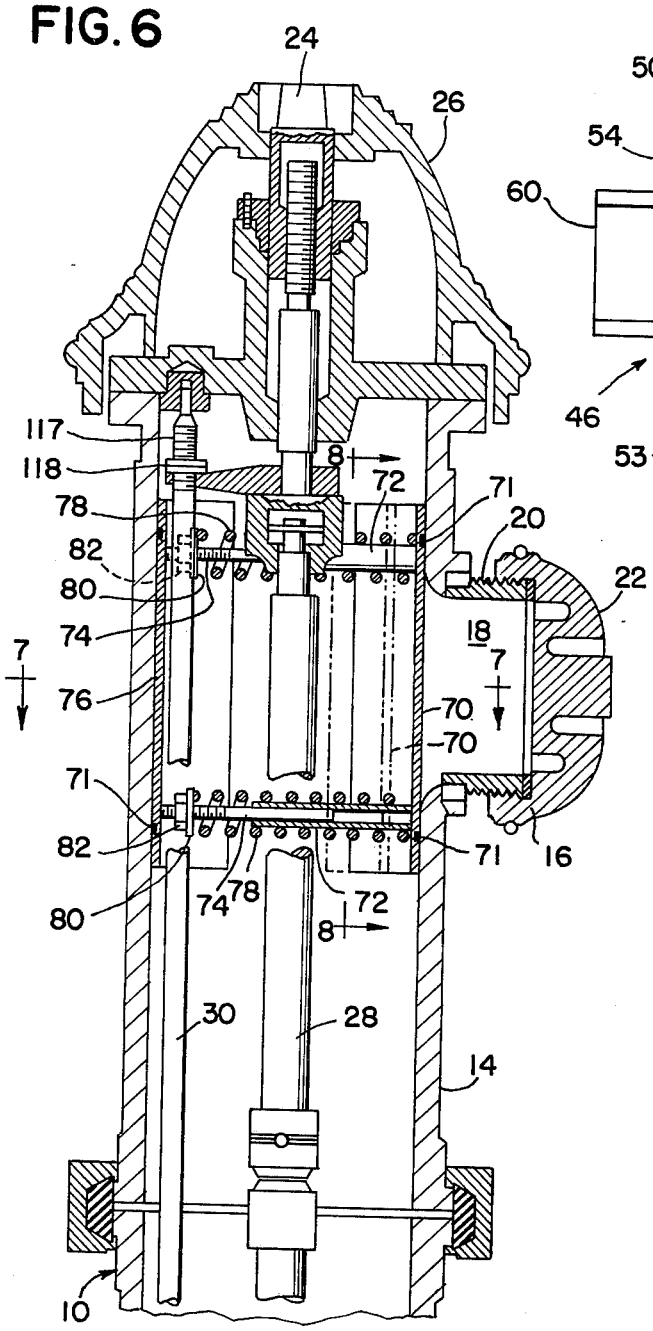
FIG. 6 is an elevational view, partly in section, of a second form of fire hydrant construction in accordance with the invention.
Figure 7:
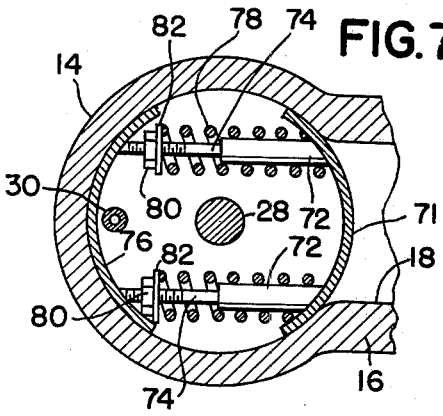
FIG. 7 is a sectional view taken on line 7—7 of FIG. 6.
Figure 8:
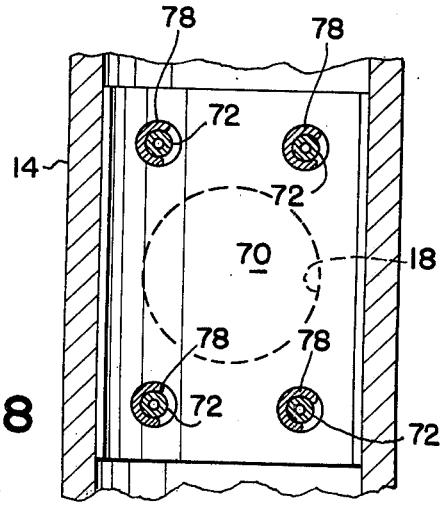
FIG. 8 is a sectional view taken on line 8—8 of FIG. 6.

In FIGS. 6, 7 and 8 there is shown another form of fire hydrant in accordance with the invention. The conventional parts of the fire hydrant shown in FIG. 6 are the same as those shown in FIG. 1 and like parts have been given the same reference numerals. The only difference is that there is provided another form of valve means for preventing the unauthorized operation of the fire hydrant. This valve means comprises a valve member 70 located within the barrel 14 and consisting of an arcuate plate which conforms in curvature to the internal wall of the cylindrical barrel 14 in the region of the outlet nozzle 16. The valve member 70 is provided with an O-ring 71 arranged to contact the internal wall of the barrel 14 in the region surrounding the opening 18. The valve member 70 is biased to a position blocking the flow from the interior of the stand pipe 10 and the barrel 14 outwardly through the steamer nozzle 16, the flow blocking position being shown in solid lines in FIG. 6.

Means are provided for guiding the valve member 70 for movement from the closed position to an open position shown in dashed lines in FIG. 6. To this end, the valve member 70 is provided with four tubular sleeves 72 which project inwardly therefrom in a transverse direction across the barrel 14. The sleeve members 72 slidably receive four transversely extending guide pins 74 which project inwardly from a back plate 76 located on the opposite portion of the barrel 14 from the opening 18. The back plate 76 consists of an arcuate plate which conforms in curvature to the internal wall of the barrel 14.

Spring means are provided for biasing the valve member 70 and the back plate 76 outwardly relative to one another against the opposed internal wall portions of the barrel 14 as is shown in FIG. 6. To this end, a compression spring 78 is mounted on each of the cooperating pins and sleeves. Each spring 78 extends between the valve member 70 and a washer 80 positioned on the associated pin 74. A nut 82 is threadedly mounted on the pin 74 for adjusting the axial position of the washer 80 to thereby vary the compression force provided by the spring 78. The parts are adjusted so that the springs 78 are maintained in a compressed condition so as to maintain a considerable force biasing the valve member 70 toward the closed position and also to hold the valve member 70 and the back plate 76 in a position aligned with the steamer nozzle 16.

The valve member 70 and the back plate 76 and the associated guide means and spring means form a unit which can be inserted into the barrel 14 through the top end thereof. In order to install this unit it is necessary to remove the top cap 26 and the associated valve operating mechanism. The unit is inserted by squeezing the valve member 70 and back plate 74 together so that they fit within the diameter of the barrel 14 and sliding the unit down into the position shown in FIG. 6 with the valve member 70 blocking the upstream end of the nozzle 16.

When it is desired to operate the fire hydrant for deliverying water to a fire hose or the like, the cap 22 is removed and a hose connection such as that shown in FIGS. 4 and 5 is connected to the nozzle 16. As the collar 50 is threaded onto the nozzle 16 the pusher bars 60 move axially inwardly to contact the valve member 70 and move it away from the upstream end of the nozzle 16 to the dashed line position shown in FIG. 6 to thereby open the upstream end of the nozzle 16 and permit the flow of water therethrough.

Figure 2:
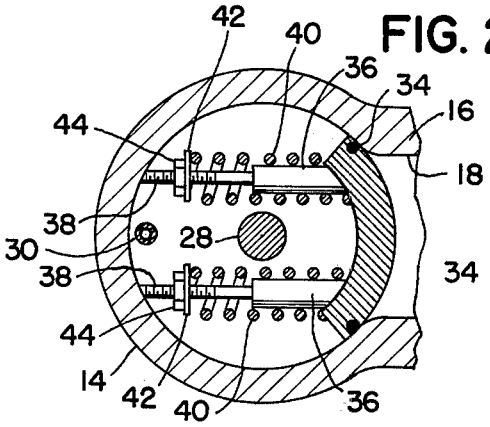
FIG. 2 is a sectional view taken on line 2—2 of FIG. 1.
Figure 3:
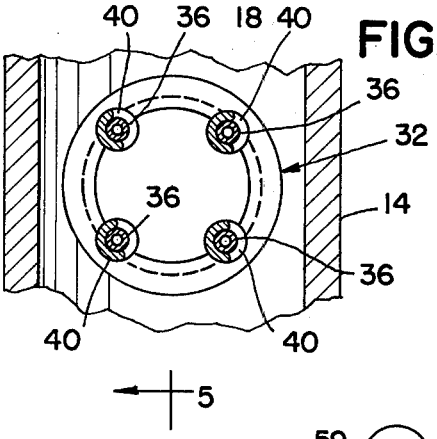
FIG. 3 is a sectional view taken on line 3—3 of FIG. 1.

It will be apparent that the valve means employed in the fire hydrants shown in FIGS. 1 to 3 and in FIGS. 6 to 8 prevent the unauthorized use of the fire hydrant by maintaining the steamer nozzle closed except under conditions when authorized personnel operate the fire hydrant by the use of the actuator means shown in FIGS. 4 and 5. Moreover, the valve means are located entirely within the barrel 14 wherefore they cannot be tampered with or removed by unauthorized personnel. Furthermore, the construction of the valve means is such that there is a minimum of resistance to flow when they are actuated to the open position.

I claim:

1. In a fire hydrant having a barrel portion located above ground and provided with a laterally extending flow outlet nozzle, the improvement comprising:

valve means located within the barrel portion for controlling the flow of water through the outlet nozzle, said valve means including a valve member movable between a closed position in an outlet opening extending across the upstream end of the outlet nozzle to block the flow of water from the interior of the barrel portion into the outlet nozzle and to prevent the insertion of articles into the barrel portion through the outlet nozzle and an open position spaced away from the upstream end of the outlet nozzle to permit the flow of water from the interior of the barrel portion into the outlet nozzle and spring means biasing said valve member towards said closed position, and valve actuator means for moving said valve member from said closed position to said open position away from the outlet nozzle against the bias of said spring means, said valve actuator means comprising a collar means adapted to be mounted on the outlet nozzle of the fire hydrant, and a valve actuating member mounted on said collar means and arranged to move the same from said closed position to said open position as said collar means is mounted in said position on the fire hydrant, said valve means being adapted to be located entirely within the barrel portion of the fire hydrant with only the valve member being exposed to view and accessible through the outlet nozzle, and guide means for guiding said valve member between said closed and open positions, said guide means extending transversely across the barrel portion and including a plurality of pins slidable within cooperating sleeves.

2. In a fire hydrant according to claim 1 wherein said spring means comprises a compression spring associated with each cooperating pair of pins and sleeves.

3. In a fire hydrant according to claim 2 including means for varying the compressed condition of said springs.

4. In a fire hydrant according to claim 1, wherein said valve means comprises a unit which is removable from said barrel portion through the upper end thereof, and wherein said unit comprises said valve member, an arcuate back plate having a curvature conforming with the internal wall of the barrel portion, and said spring means.

5. In a fire hydrant according to claim 4 wherein said valve member comprises an arcuate plate having a curvature conforming to the internal wall of the barrel portion.

6. In a fire hydrant according to claim 1, said valve actuator means including a first collar adapted to be mounted on the outlet nozzle of the fire hydrant, a second collar adapted to be attached to a hose, connecting means attaching the collars together so that they are freely rotatable relative to each other, and handles mounted on the collars to provide for easy rotation of the collars.

7. In a fire hydrant having a barrel portion located above ground and provided with a laterally extending flow outlet nozzle, the improvement comprising valve means located within the barrel portion for controlling the flow of water through the outlet nozzle, said valve means including a valve member movable between a closed position extending across the upstream end of the outlet nozzle, to block the flow of water from the interior of the barrel portion into the outlet nozzle and to prevent the insertion of articles into the barrel portion through the outlet nozzle, and an open position spaced from the upstream end of the outlet nozzle to permit the flow of water from the interior of the barrel portion into the outlet nozzle, and spring means biasing said valve member towards said closed position, and valve actuator means for moving said valve member from said closed position to said open position against the bias of said spring means, said valve actuator means comprising a collar means adapted to be mounted on the fire hydrant in a position surrounding the outlet nozzle, and a valve actuating member mounted on said collar means and arranged to move into the outlet nozzle to contact the valve member to move the same from said closed position to said open position as said collar means is mounted in said position on the fire hydrant, said valve means comprising a unit which is removable from said barrel portion through the upper end thereof, said valve means including said valve member, an arcuate back plate having a curvature conforming with the internal wall of the barrel portion, said back plate engaging the internal wall of said barrel portion, and said spring means, said spring means being positioned in compression between said back plate and said valve member, said valve member being movable toward and away from said back plate when moved between said open and closed positions thereof.

* * * * *